US007225720B2

(12) United States Patent
Lampinen

(10) Patent No.: US 7,225,720 B2
(45) Date of Patent: Jun. 5, 2007

(54) RADIAL PISTON HYDRAULIC MOTOR AND METHOD IN THE CONTROL OF A RADIAL PISTON HYDRAULIC MOTOR

(75) Inventor: Mika Kalervo Lampinen, Haapaniemi (FI)

(73) Assignee: Sampo-Hydraulics Oy, Jyska (FI)

( * ) Notice: Subject to any disclaimer, the term of this patent is extended or adjusted under 35 U.S.C. 154(b) by 575 days.

(21) Appl. No.: 10/816,453

(22) Filed: Apr. 1, 2004

(65) Prior Publication Data

US 2004/0194619 A1 Oct. 7, 2004

(30) Foreign Application Priority Data

Apr. 1, 2003 (FI) ..... 20030484

(51) Int. Cl.
*F01B 1/00* (2006.01)

(52) U.S. Cl. ..... 91/473; 91/497; 91/498

(58) Field of Classification Search ..... 91/491, 91/473, 497, 498, 494, 468, 212, 214; 60/494, 60/468; 417/212, 214
See application file for complete search history.

(56) References Cited

U.S. PATENT DOCUMENTS

| | | | | | |
|---|---|---|---|---|---|
| 2,315,076 | A | * | 3/1943 | Orshansky, Jr. et al. | 91/473 |
| 2,562,363 | A | * | 7/1951 | Nixon | 91/473 |
| 3,107,632 | A | * | 10/1963 | Wahlmark | 91/473 |
| 3,250,227 | A | * | 5/1966 | Kouns | 91/473 |
| 3,283,612 | A | | 11/1966 | Densham | 74/687 |
| 3,418,941 | A | * | 12/1968 | Mowbray | 91/473 |
| 3,808,949 | A | * | 5/1974 | Muncke et al. | 91/473 |
| 3,913,455 | A | | 10/1975 | Green et al. | 91/492 |
| 3,999,465 | A | | 12/1976 | Burnight | 91/498 |
| 4,256,018 | A | | 3/1981 | Badoureaux et al. | 92/58 |
| 4,716,816 | A | | 1/1988 | Falt | 91/491 |
| 4,945,816 | A | * | 8/1990 | Mestieri | 91/473 |
| 5,224,411 | A | | 7/1993 | Fillion | 91/525 |
| 6,290,468 | B1 | * | 9/2001 | Kato et al. | 417/222.2 |

FOREIGN PATENT DOCUMENTS

| | | |
|---|---|---|
| FI | 72179 | 12/1986 |
| FR | 2426801 | 1/1980 |
| GB | 915 231 | 1/1963 |

* cited by examiner

*Primary Examiner*—Anthony Stashick
*Assistant Examiner*—Vikansha Dwivedi
(74) *Attorney, Agent, or Firm*—Wolf Block Schorr & Solis-Cohen LLP; William H. Dippert

(57) ABSTRACT

The invention relates to a radial piston hydraulic motor (100) and to a method in the control of a radial piston hydraulic motor. The radial piston hydraulic motor (100) includes a free rotation valve (50) which is built inside it and includes a spindle (19). The spindle (19) is disposed in a spindle cavity (20) and it is movable in the spindle cavity (20) such that, in a free rotation situation, shoulders of the spindle (19) block the inlet and outlet passages of working pressure. In a free rotation situation, springs ($U_1$, $U_2$ . . . ) press pistons (13$a_1$, 13$a_2$ . . . ) and press rollers (14$a_1$, 14$a_2$ . . . ) associated therewith to a bottom position and out of contact with a cam ring (11).

10 Claims, 6 Drawing Sheets

RADIAL PISTON HYDRAULIC MOTOR AND METHOD IN THE CONTROL OF A RADIAL PISTON HYDRAULIC MOTOR

FIELD OF THE INVENTION

The invention relates to a radial piston hydraulic motor and to a method in the control of a radial piston hydraulic motor.

BACKGROUND OF THE INVENTION

In prior art there is known a radial piston hydraulic motor design in which a cam ring is connected to a box frame. The cam ring is a wave-shaped structure, and pistons connected to a non-revolving piston frame can be pressed one after another against the inner surface of the wave-shaped structure. Some of the pistons are in a working phase and some of them in a return phase. The supply of oil into the piston frame is regulated through a distributor valve, which revolves with the box frame. The piston frame is connected with the central non-revolving central shaft.

From the prior art designs, separate neutral position valves are known through which the motor can be disengaged to be in a neutral state so that the box frame and a structure associated therewith, for example, a wheel of a vehicle, can be rotated freely. The neutral position valves in accordance with the prior art are component units which are outside the structure and which, with their extra hoses and connections, increase the price of the system and slow down installation.

OBJECTS AND SUMMARY OF THE INVENTION

The objective of this invention is to resolve the disadvantages mentioned by developing a distiller for liquids and equipment for treating the sewage which, from the point of view of energy expenditure and space occupation, satisfactorily resolves the problems of elimination of sewage on moving equipment, such as railway rolling stock.

OBJECTS AND SUMMARY OF THE INVENTION

This application discloses a radial piston hydraulic motor design in which a neutral position valve, i.e. a free rotation valve, is integrated inside a radial piston hydraulic motor. Said free rotation valve enables the hydraulic motor to be disengaged for free rotation and again engaged for operation. In that connection, a separate free rotation valve outside the hydraulic motor is not needed.

In accordance with the invention, the valve is constructed in the frame of the radial piston hydraulic motor itself and, in the embodiment shown in the figures, in the central shaft thereof. The central shaft includes a spindle cavity for a separate movable spindle. In accordance with the invention, a spring is provided at the end of the spindle placed in the spindle cavity, so that control pressure can be passed to the end of the spindle. When control pressure is passed to the end of the spindle, said spindle can be moved to different positions in the spindle cavity. One position provides a neutral state in accordance with the invention, in which state the inlet line and the return line of working pressure are blocked and in which state the springs connected with the pistons have pressed the pistons to the bottom position, so that the piston rollers connected to the pistons are spaced from the wave-shaped cam ring.

In the most general embodiment of the invention, the free rotation valve including a spindle in accordance with the invention can be generally used in a radial piston hydraulic motor that includes a piston frame, a central shaft, a box frame and a distributor valve. The invention can relate to a radial piston hydraulic motor in which the box frame is rotated or to a radial piston hydraulic motor in which the box frame is in a fixed position and the central shaft is rotated. In accordance with the invention, the spindle blocks the pressure lines in a free rotation situation and in the arrangement in accordance with the invention, in a free rotation situation, both the working phase passages and the return phase passages leading from the pistons are connected in series with one another and, advantageously, said series connection is additionally in hydraulic fluid communication with the box frame. Thus, by means of the valve in accordance with the invention and by operating it, the working pressure line and the return pressure line are blocked in a free rotation situation. In accordance with the invention, said blocking takes place inside the radial piston hydraulic motor by operating the spindle of the neutral position valve placed in the radial piston hydraulic motor so that its shoulders block the inlet line of working pressure and its return line, i.e. outlet line in a free rotation situation. The lines are also called passages.

Advantageously, the device arrangement is such that control pressure acts on the end of the spindle in a normal drive state and during free rotation said end is not acted on by means of control pressure.

In accordance with the invention, the spindle is provided with separate shoulders, which block the inlet line and the return line of working pressure in a free rotation situation.

The radial piston hydraulic motor and the method in the control of the radial piston hydraulic motor according to the invention are characterized by what is stated in the claims.

BRIEF DESCRIPTION OF THE DRAWINGS

In the following, the invention will be described with reference to the appended drawings, to some advantageous embodiments of the invention shown in the figures. In the drawings:

FIG. 4 does not show a cam ring and a central shaft.

DETAILED DESCRIPTION OF THE INVENTION

Figure 1:
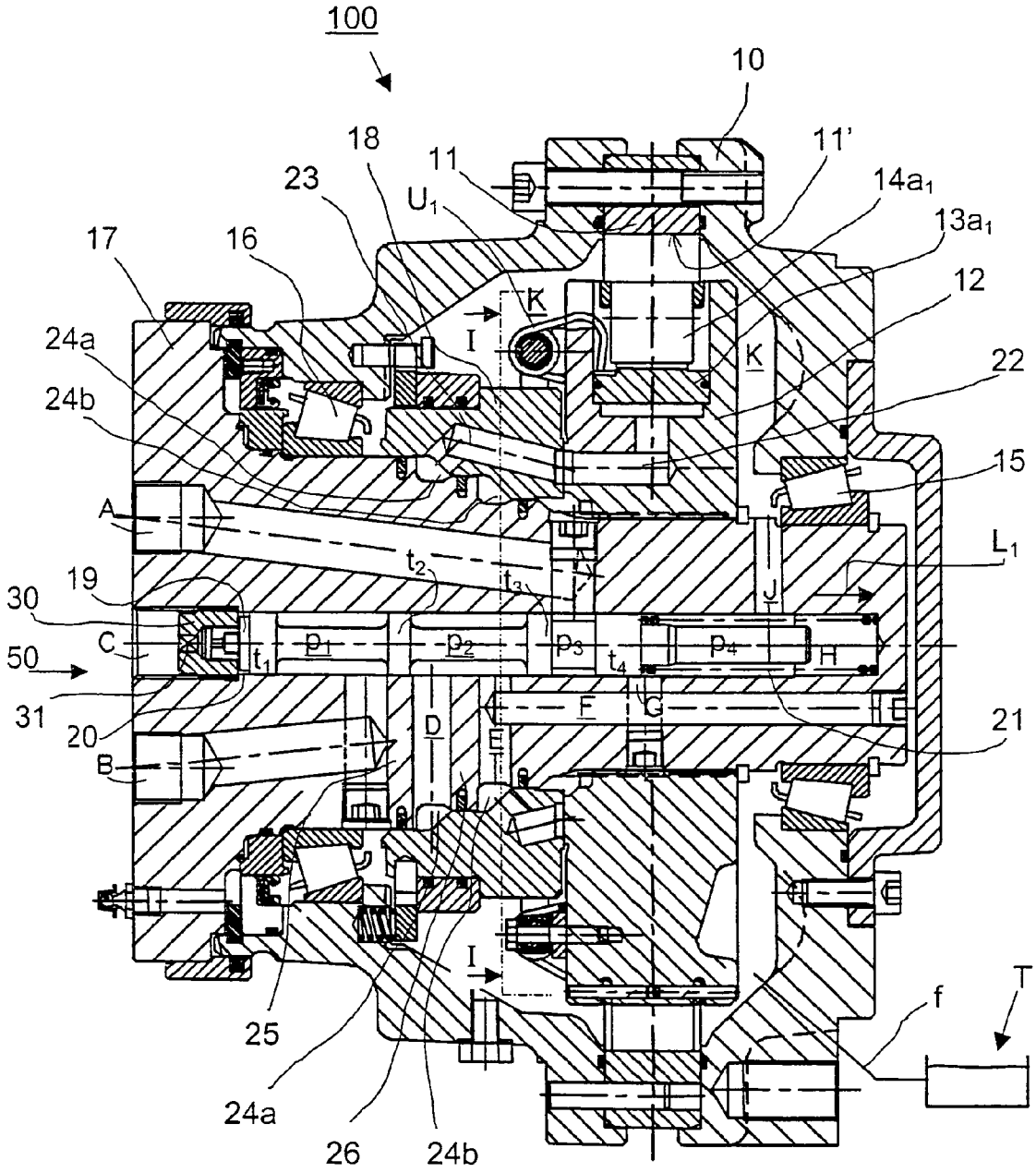
FIG. 1 is a sectional view of a radial piston hydraulic motor in accordance with the invention in a free rotation situation.

FIG. 1 shows a free rotation situation.

If there is no control pressure in a passage C, a radial piston hydraulic motor 100 is in a free rotation state. In that connection, a spindle 19 is in an extreme position on the left by the action of a spring 21, so that both an inlet line, i.e. a pressure passage B, and a return passage A of working pressure are blocked and pistons 13$a_1$, 13$a_2$ . . . are at the bottom, with the result that a box frame 10 of the radial piston hydraulic motor 100 can be rotated freely by external force, i.e. the radial piston hydraulic motor 100 is, so to speak, freely rotatable. The passages can also be called lines.

FIG. 1 shows the radial piston hydraulic motor 100 in accordance with the invention in a free rotation situation. The main parts of the radial piston hydraulic motor 100 in accordance with the invention are described based on FIG. 1. The radial piston hydraulic motor 100 illustrated in the figure is shown as a longitudinal sectional view. The radial piston hydraulic motor 100 includes a box frame 10. A cam ring 11 revolving with the revolving box frame 10 is connected to said revolving box frame. A non-revolving piston frame 12 includes the pistons 13$a_1$, 13$a_2$ . . . , each piston 13$a_1$, 13$a_2$ including a press wheel or a press roller 14$a_1$, 14$a_2$ . . . , which can be pressed by means of the pressure of a hydraulic fluid, such as hydraulic oil, against an inner surface 11' of the cam ring 11. The cam ring 11 is a wave-shaped structure, so that when the piston 13$a_1$, 13$a_2$ . . . with its press wheel 14$a_1$, 14$a_2$ . . . is pressed with force against the cam ring 11, the press wheel conforms to the shape of the cam ring and thus rotates, with a desired force, the cam ring 11 and the box frame 10 associated therewith and further, for example, a wheel of a vehicle or another object to the driven.

The figure shows a bearing 15 and a bearing 16 by means of which the box frame 10 is arranged to rotate with respect to a central shaft 17. The central shaft 17 is a non-revolving shaft. A distributor valve 18 is connected to the box frame 10 and rotates therewith. The distributor valve 18 includes bores 23 from one frontal face thereof to another and further to the pistons 13$a_1$, 13$a_2$ . . . , to the cylinder spaces of the pistons, through passages 22 situated in the piston frame 12, which passages allow working pressure to be transferred, as desired, from the passage B to the piston 13$a_1$, 13$a_2$ . . . which is in the working phase at each particular time and through which distributor valve 18 a hydraulic fluid, such as hydraulic oil, can be passed from the pistons 13$a_1$, 13$a_2$ . . . which are in the return phase to return circulation and to the return passage A. The device arrangement comprises a so-called free rotation valve 50. The control spindle 19 of the free rotation valve 50 in accordance with the invention is placed in a spindle cavity 20 in the centre of the central shaft 17. The control spindle 19 includes shoulder portions $t_1$, $t_2$, $t_3$, $t_4$ and axial portions $p_1$, $p_2$, $p_3$, $p_4$ of a smaller cross-section between them. Around the axial portion $p_4$ there is a spring 21, the spindle 19 being moved against the force of said spring by means of a pressure provided at the end of the spindle from the control pressure passage C. A passage 22 leads from each piston 13$a_1$, 13$a_2$ . . . to the distributor valve 18 and further in connection with the distributor valve 18 there are passages 23 opening into an annular groove 24*a* situated on the outer surface of the shaft 17. In the figure, the pressure passages are denoted with the letters B and D and the return passages are denoted with the letters E and A. The passage E is connected with an axial passage F which is connected with a passage G opening into the end of the spindle cavity 20. The passage E is a radial passage and it also opens at its end into the spindle cavity 20. Between the passages B and D there is a wall 25, a so-called partition wall. The passages B and D open into the spindle cavity 20. When the shoulder $t_2$ of the spindle 19 is at the wall 25, the passages A and B are, so to speak, blocked with respect to each other, i.e. flow communication between them is prevented and the box frame 10 of the radial piston hydraulic motor 100 can be rotated freely. In that connection, springs $U_1$, $U_2$ . . . have pressed the press wheels 14$a_1$, 14$a_2$ of the pistons 13$a_1$, 13$a_2$ . . . to the bottom position, so that the press wheels 14$a_1$, 14$a_2$ . . . are spaced from the cam ring 11. The passages D and E and the inlet passages and return passages 23 of the distributor valve 18 then communicate in series with one another. The shoulder $t_3$ of the spindle 19 prevents the space between the shoulders $t_2$ and $t_3$ from being in communication with the return passage A. The shoulder $t_2$ prevents communication with the pressure line B. The passages 23 of the distributor valve 18 are in communication with one another through the spindle cavity 20 at the area between the shoulders $t_2$ and $t_3$, so that oil can flow from below the pistons 13$a_1$, 13$a_2$ . . . while assisted by the springs $U_1$, $U_2$ . . . through the passages D, E, F, G, a space H and a passage J into a box K, so that the press wheels 14$a_1$, 14$a_2$ . . . of the pistons 13$a_1$, 13$a_2$ . . . separate from the cam ring 11 and the box frame 10 of the radial piston hydraulic motor 100 can be rotated freely.

When the spindle 19 is moved in the direction indicated by the arrow $L_1$ in the figure by means of the pressure of a hydraulic fluid, such as oil, passed into the passage C against the spring force of the spring 21, the shoulder $t_2$ of the spindle 19 is moved to a position in which the shoulder $t_2$ is at the partition wall 26 and the pressure passage B is in communication with the oil passages of the working side of the distributor valve 18, and the oulets of the distributor valve 18 are further connected to the outlet passage A. In that connection, the pressure side B and the outlet side A are connected with each other through the distributor valve 18 and the pistons 13$a_1$, 13$a_2$ . . . The passages 23 of the distributor valve 18 provided for the pistons 13$a_1$, 13$a_2$ . . . which are in the working phase open into the annular groove 24*a* and the passages 23 of the distributor valve 18 provided for the pistons 13$a_1$, 13$a_2$ . . . which are in the return phase open into a second annular groove 24*b*. The passage C includes a plug 30 and a through-hole 31 in it for a hydraulic fluid. The plug 30 keeps the spindle 19 in the spindle cavity 20.

The inlet passages 23 of the distributor valve 18 open into the passage D situated in the shaft 17 and the return passages 23 thereof open into the passage E situated in the shaft 17. The passages D and E open into the spindle cavity 20. The axial passage F is connected with the passage E and the passage G, which extends radially in the shaft 17 and opens into the end area of the spindle cavity 20, is connected with the axial passage F. The return passage A opens into the spindle cavity 20 at the area between the passages E and G. From the interior space K of the box 10 there is the passage J in the shaft 17, which passage J opens into the spindle cavity 20 at the end area thereof. The spindle 19 includes the shoulders $t_1$, $t_2$, $t_3$ and $t_4$, advantageously shoulders of circular cross-section, and the smaller-diameter spindle portions $p_1$, $p_2$, $p_3$, $p_4$ between them, the cross-section of said spindle portions being advantageously circular. The spring 21 is situated around the portion $p_4$ between the shoulder $t_4$ and the end of the spindle cavity 20. The passage B includes an end passage portion which extends radially in the shaft 17 and opens into the spindle cavity 20. The partition wall 25 is placed between it and the radially extending passage D. Between the passage E, which extends radially in the shaft 17 and opens into the spindle cavity 20, and the passage D there is also the partition wall 26.

In the device arrangement, in the drive state of the motor, the shoulder $t_2$ of the spindle 19 is at the partition wall 26, so that the pressure passage B of the radial piston hydraulic motor 100 communicates, through the space 20 between the shoulders $t_1$ and $t_2$, with the passage D, the passages 23 of the distributor valve 18 and with the pistons 13$a_1$, 13$a_2$ . . . which are in the working phase. The return passages 23 of the distributor valve 18 and the pistons 13$a_1$, 13$a_2$ . . . which are in the return phase communicate with the return passage A between the passage E and the shoulders $t_2$ and $t_3$ via the spindle cavity 20 of the spindle 19. In the free running state when the motor 100 does not drive, the springs $U_1$, $U_2$ . . . press the pistons 13$a_1$, 13$a_2$ . . . to the bottom position, so that the pressure lines A and B are blocked and the working phase and return phase passages 23 of the distributor valve 18 communicate with one another through the passages D and E and the spindle cavity 20 at the area between the shoulders $t_2$ and $t_3$ of the spindle 19.

The special features of the invention are described in greater detail below.

Figure 2:
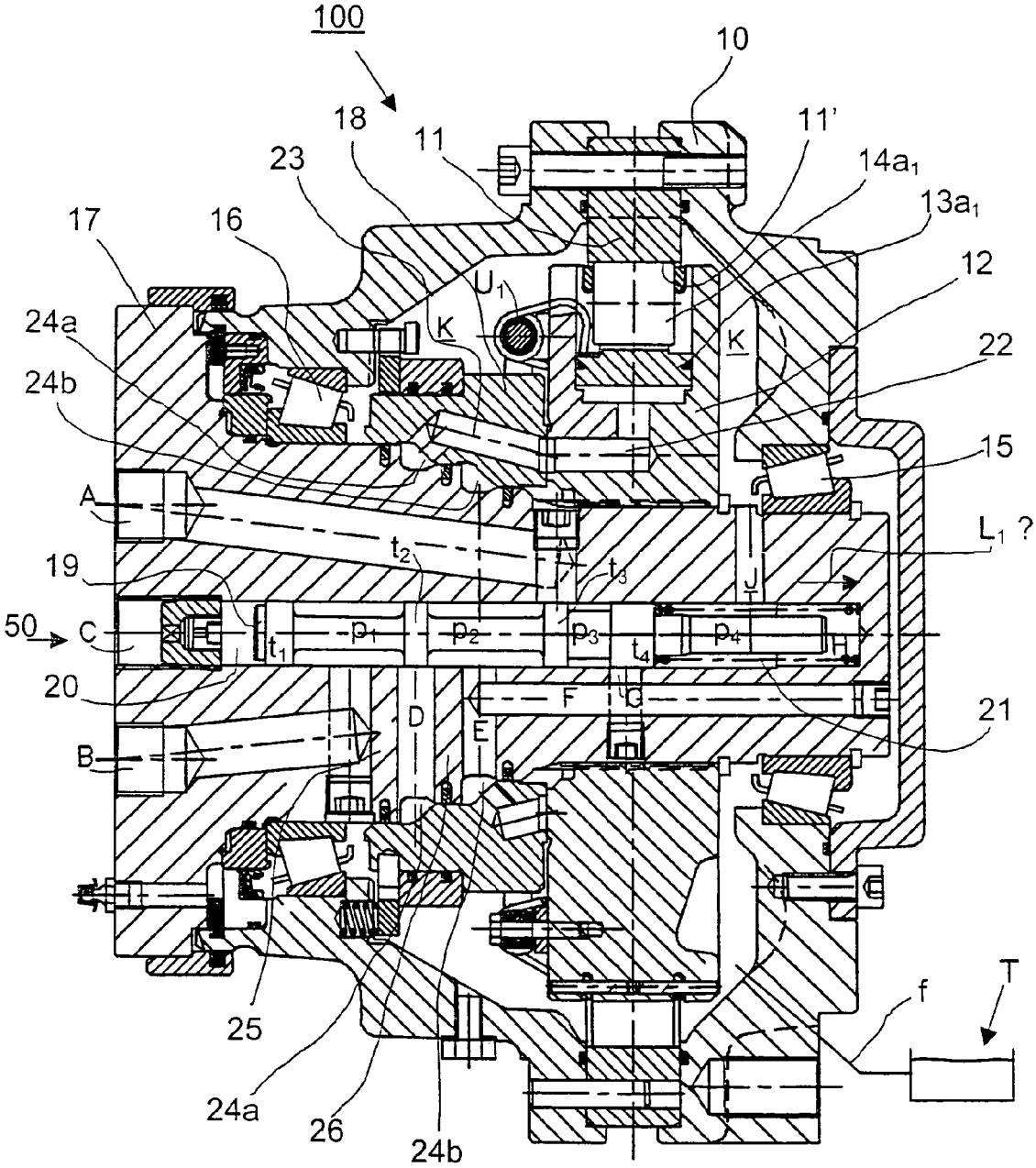
FIG. 2 shows the radial piston hydraulic motor in accordance with the invention at the stage where the motor is engaged to drive. The illustration is a sectional view.

FIG. 2 shows the phase in which the radial piston hydraulic motor 100 is engaged to drive.

When a pressure force exceeding the compression of the spring (21) is passed to the line C, the spindle 19 is caused to move to the right. The line G closes, so that pressure cannot any more enter, from below the pistons 13$a_1$, 13$a_2$ . . . , the interior space K of the box 10. When the second shoulder $t_2$ of the spindle 19 from the left is at the line D, the pressure is momentarily able to pass from the line B to the lines D and E, and therefrom through the distributor valve 18 again below the pistons 13$a_1$, 13$a_2$ . . . Consequently, the pistons 13$a_1$, 13$a_2$ . . . are caused to rise from their bottom position towards the cam ring 11. The high working pressure of the line B is momentarily lowered because at this moment there is also communication with the line A having a smaller pressure.

When the pistons 13$a_1$, 13$a_2$ . . . and the piston rollers 14$a_1$, 14$a_2$ . . . are moving towards the cam ring 11, a pressure is generated inside the box frame 10 because of the throttling action of a normal hose line f leading from the interior space K of the box 10 to a tank T. The pressure of the interior space K of the box 10 also acts through the passage J on the end of the spindle 19 at the side of the spring 21, and on the shoulder $t_4$. In that connection, the speed of movement of the spindle 19 to the right (arrow $L_1$) slows down because of the pressure force acting on the shoulder $t_4$ such that high pressure peaks are not produced at any stage in the interior space K of the box 10. The passage J is a radial passage situated in the shaft 17 and it opens into the interior space K of the box 10 and into the end of the spindle cavity 20.

Figure 3:
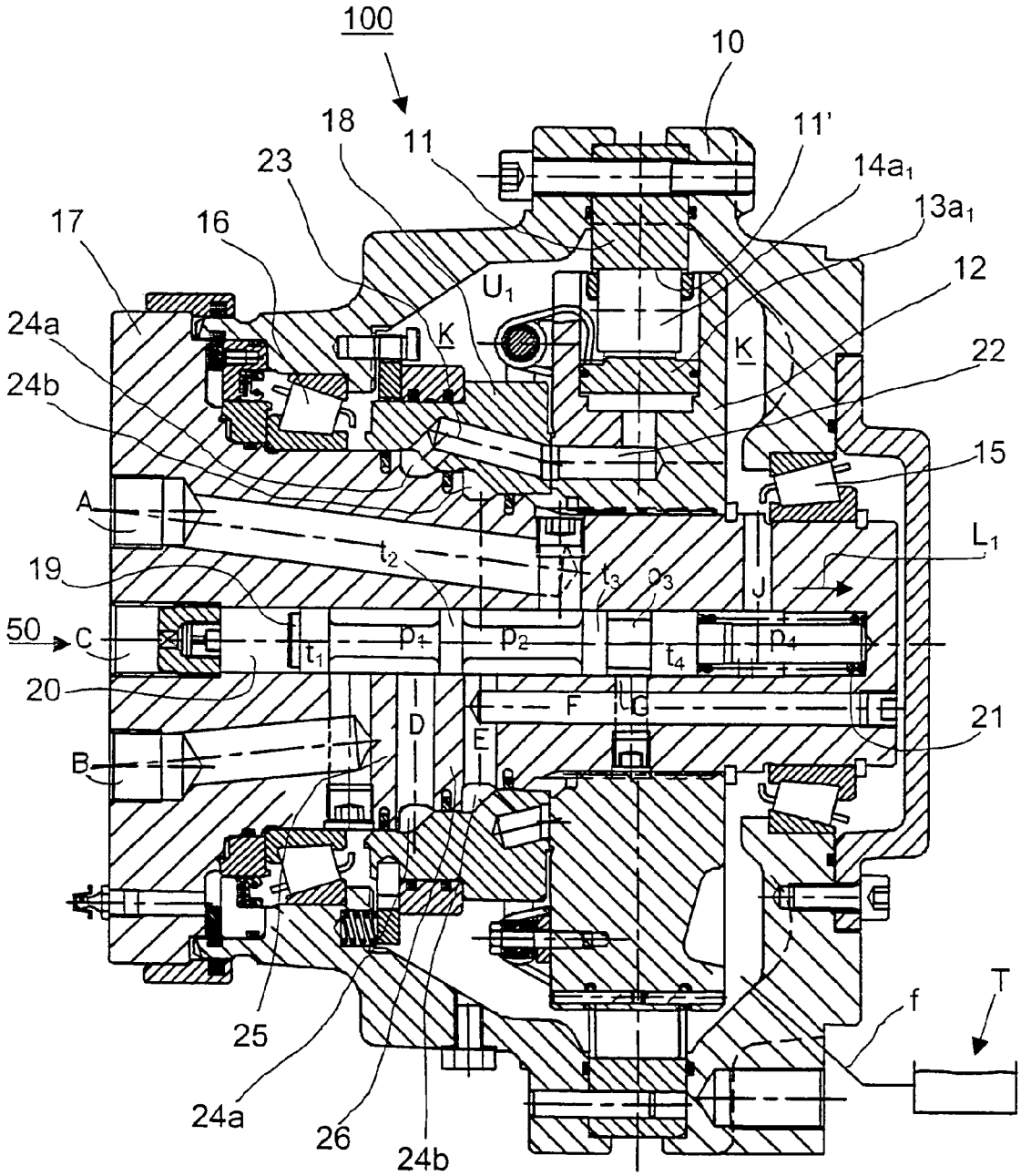
FIG. 3 shows the motor in accordance with the invention in a drive state in which control pressure acts on the end of a spindle.

FIG. 3 shows a normal drive state (control pressure acts on the passage C).

When the piston rollers 14$a_1$, 14$a_2$ . . . have reached the cam ring 11, the radial piston hydraulic motor 100 is in a normal drive state. The shoulder $t_2$ of the spindle 19 separates the pressure lines B and A as well as the passages D and E from one another. Oil flows from the passage B through the line D to the distributor valve 18 and further under the pistons 13$a_1$, 13$a_2$ . . . In the return phase of the pistons 13$a_1$, 13$a_2$ . . . (at that time, the pistons 13$a_1$, 13$a_2$ . . . move towards the centre of the radial piston hydraulic motor 100), oil is passed from below the pistons 13$a_1$, 13$a_2$ . . . through the distributor valve 18 to the passage E and further to the line A. The spindle 19 is in a position in which the radial passage E opens into the space between the shoulders $t_3$ and $t_4$, so that pressure has access from the line E only into the passages F and G and into the space between the shoulders $t_3$ and $t_4$ in the spindle cavity 20. The shoulder $t_4$ prevents pressure communication with the passage J and with the interior space K of the box 10.

Transition to Neutral Position

When the control pressure is removed from the line C, the spindle 19 starts to return to the left by means of the spring 21. When the spindle 19 is completely on the left (FIG. 1), oil is able to flow from under the pistons 13$a_1$, 13$a_2$ . . . through the distributor valve 18 and the passages D and E to the passages F and G and further through the end space H of the spindle cavity 20 and through the passage J to the interior space K of the box 10, from where there is the box line f leading to the tank T. There is the same pressure above and below the pistons 13$a_1$, 13$a_2$ . . . , so that the free rotation springs $U_1$, $U_2$ . . . and the cam ring 11 (when revolving) are needed to press the pistons 13$a_1$, 13$a_2$ . . . to their bottom position. When all pistons 13$a_1$, 13$a_2$ . . . are in the bottom position, the motor can be rotated freely. When the direction of rotation of the radial piston hydraulic motor 100 is changed, a higher-pressure working pressure is passed to the passage A, so that a lower-pressure return line is formed by the passage B. The operation of the radial piston hydraulic motor 100 is otherwise the same.

In the embodiments shown in the above-mentioned figures, the spindle 19 is constructed such that in a situation where no pressure is passed into the passage C, the spring 21 holds the spindle 19 in a position that provides free rotation. When control pressure is passed into the passage C, the spindle 19 is moved to a position in which a normal drive state is provided.

Figure 4:
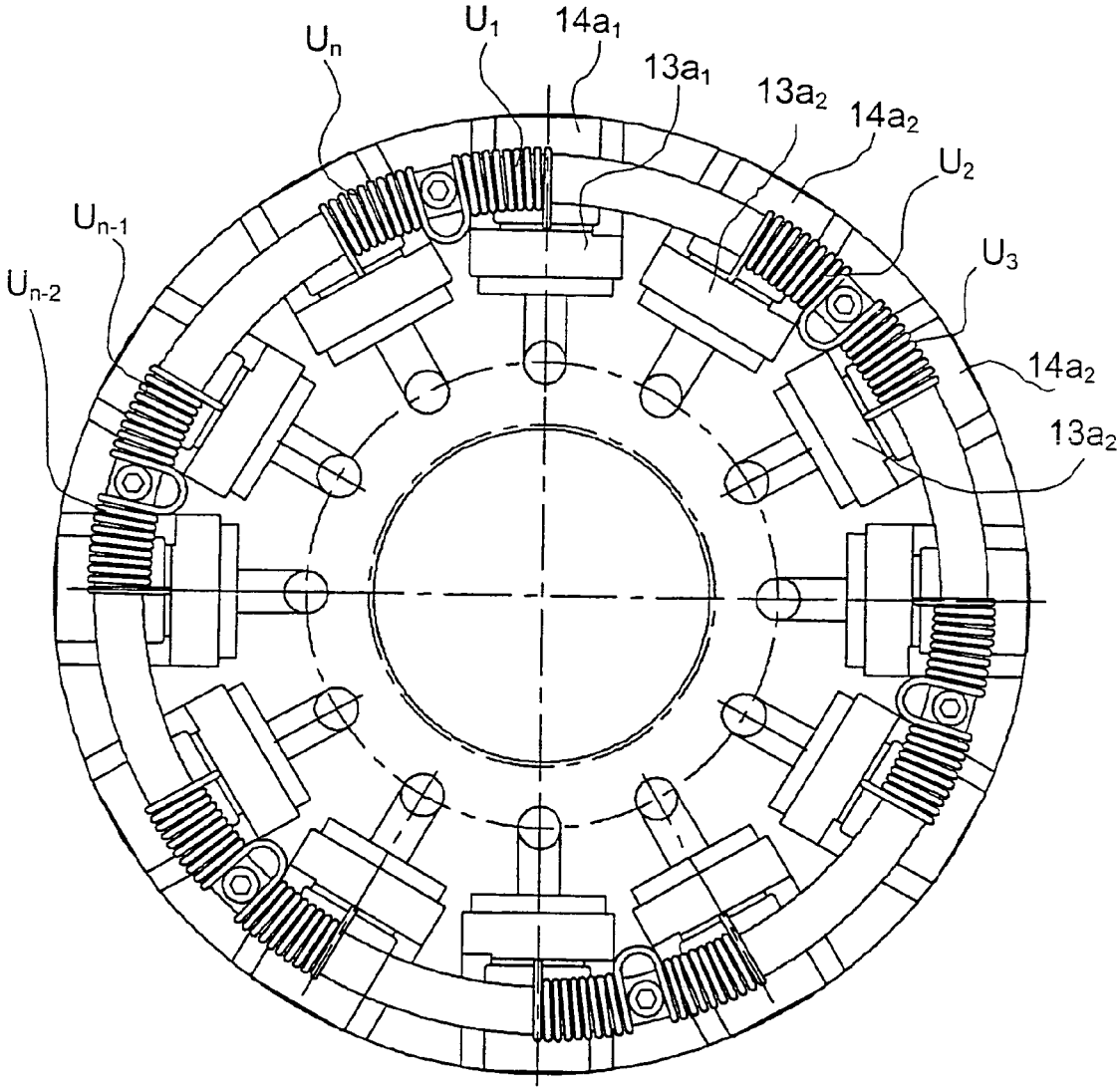
FIG. 4 is a partial sectional view along I—I of FIG. 1. A piston frame and springs associated with pistons are shown.

FIG. 4 is a sectional view along I—I of FIG. 1. The figure is a partial sectional view. The piston frame 12 and the springs $U_1$, $U_2$ . . . associated with the pistons 13$a_1$, 13$a_2$ . . . are shown. The cam ring 11 and the central shaft 17 are not shown in the figure. The pistons 13$a_1$, 13$a_2$ . . . and the press rollers 14$a_1$, 14$a_2$ . . . associated with them are pressed by means of the springs $U_1$, $U_2$ . . . out of contact with the inner surface of the cam ring 11 in a free rotation situation.

Figure 5A:
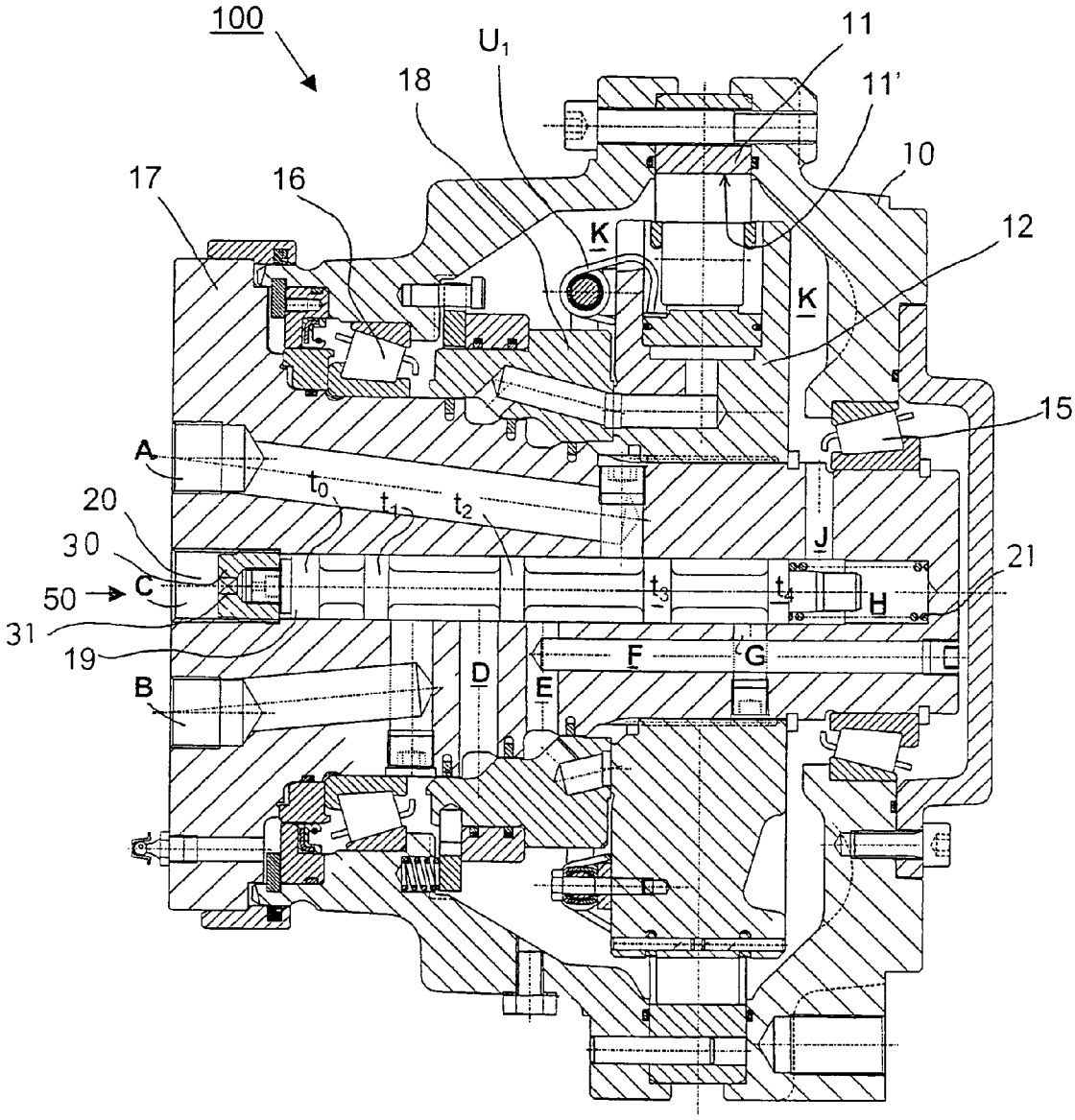
FIG. 5A shows a second embodiment of the spindle in a position in which no control pressure has been passed to a passage C and in which a spring keeps the spindle in a position in which the radial piston hydraulic motor drives.
Figure 5B:
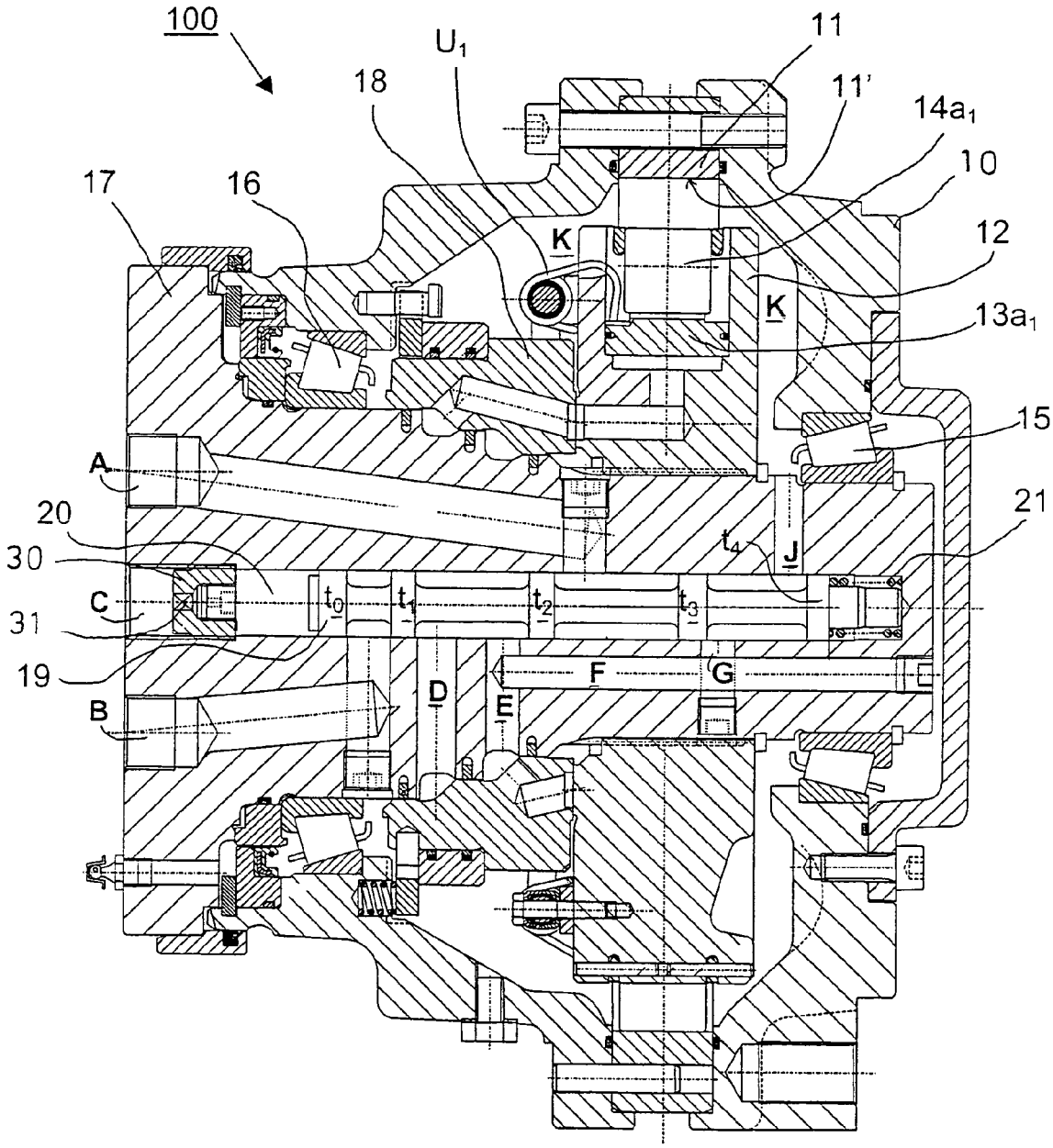
FIG. 5B shows a stage in which control pressure has been passed into the passage C and the radial piston hydraulic motor is in a free rotation situation.

FIGS. 5A and 5B show a second embodiment of the spindle 19 of the invention, the operation mode being different in the embodiment. When no control pressure is passed into the passage C, the spindle 19 is kept by means of the spring 21 in a position in which a drive situation is realized, and when control pressure is passed into the passage C, the spindle 19 is moved against the spring force of the spring 21 to a position in which a neutral position situation is realized. In the phase of FIG. 5A, no control pressure has been passed into the passage C and the spindle 19 is in a position in which a drive situation is realized, and in the illustration of FIG. 5B, control pressure has been passed into the passage C and the spindle 19 has been moved to a position in which the shoulders $t_1$ and $t_2$ block the pressure lines A and B and the radial piston hydraulic motor 100 is freely rotatable, i.e. in a free rotation state.

A free rotation valve 50 built inside the radial piston hydraulic motor 100 is used in the method for control of the radial piston hydraulic motor in accordance with the invention. The free rotation valve 50 comprises the spindle 19, which is moved in the spindle cavity 20. In accordance with the invention, the radial piston hydraulic motor 100 is controlled such that the shoulders $t_1$ and $t_2$ of the spindle 19 in the free rotation situation block the inlet and outlet passages A and B of the working pressure, so that in the free rotation situation the pistons 13$a_1$, 13$a_2$ . . . and the press rollers 14$a_1$, 14$a_2$ . . . associated with them are pressed by means of the springs $U_1$, $U_2$ . . . to the bottom position and out of contact with the cam ring 11. The radial piston hydraulic motor 100 can then be rotated freely.

Furthermore, in the method in accordance with the invention, the passages of the distributor valve 18 leading to the pistons 13$a_1$, 13$a_2$ . . . which are in the working phase and the passages of the distributor valve 18 leading from the pistons 13$a_1$, 13$a_2$ . . . which are in the return phase are connected in series in the free rotation situation and, in addition, said system of passages connected in series is connected to the interior space K of the box frame 10. In the method in accordance with the invention, control of the radial piston hydraulic motor 100 takes place by linearly moving the spindle 19 placed in the spindle cavity 20 of the central shaft 17.

The operation shown in FIGS. 5A and 5B can also be accomplished by the design of FIGS. 1–3 such that the spring 21 is moved to the left end of the spindle 19 shown in FIG. 1 and, correspondingly, an external control pressure is passed to the right end of the spindle 19 shown in FIG. 1. In that case, the right-hand end of the spindle 19 must be provided with an additional shoulder t for receiving pressure and a line C for supplying control pressure. When the control pressure is now passed to the right side of the additional shoulder t, the radial piston hydraulic motor 100 is disengaged to rotate freely. Without said control pressure for the right end of the spindle 19, the radial piston hydraulic motor 100 is in the normal drive state while the spring 21 in this embodiment moves the spindle 19 to the right (arrow $L_1$) to one extreme position of the spindle 19.

In this application, control pressure, advantageously the pressure of a hydraulic fluid, such as hydraulic oil, passed to the passage C is used for moving the spindle 19. The spindle 19 can also be moved by means of an actuator, for example, an electric motor. Within the scope of the invention, it is possible to replace the spring 21 at the end of the spindle 19, for example, with an air spring.

The invention claimed is:

1. A radial piston hydraulic motor which includes a box frame (10) with a cam ring (11) connected thereto and pistons (13$a_1$, 13$a_2$ . . . ) in a piston frame (12) and press rollers (14$a_1$, 14$a_2$ . . . ) in the pistons, which press rollers can be pressed by means of the pressure of a hydraulic fluid, such as hydraulic oil, against an inner surface (11') of the cam ring (11), and that the piston frame (12) is connected to a central shaft (17), and that there is a distributor valve (18) that includes bores (23) through which hydraulic oil can be passed into and out of connection with the pistons (13$a_1$, 13$a_2$ . . . ), the device arrangement including a working pressure inlet passage (B) for the hydraulic fluid and a return passage (A) for the hydraulic fluid which is not under working pressure, wherein the radial piston hydraulic motor (100) includes a free rotation valve (50) which is built inside it and includes a spindle (19) which is disposed in a spindle cavity (20) and which is movable in the spindle cavity (20) such that, in a free rotation situation, shoulders of the spindle (19) block the working pressure inlet and outlet passages (A, B), so that, in a free rotation situation, springs ($U_1$, $U_2$ . . . ) press the pistons (13$a_1$, 13$a_2$ . . . ) and the press rollers (14$a_1$, 14$a_2$ . . . ) associated therewith to a bottom position and out of contact with the cam ring (11).

2. A radial piston hydraulic motor as claimed in claim 1, wherein the spindle (19) includes a spring (21) at an end thereof, so that when an end of the spindle (19) is not acted upon by means of a control pressure through a passage (C), the spring (21) keeps the spindle (19) in one of its extreme positions.

3. A radial piston hydraulic motor as claimed in claim 1, wherein the spindle (19) includes shoulders ($t_1$, $t_2$, $t_3$, $t_4$) the diameter of which is larger than that of spindle portions ($p_1$, $p_2$, $p_3$, $p_4$) between them, and in that there is a spring (21) that is placed around a spindle portion ($p_4$) between the end of the spindle cavity (20) and a shoulder ($t_4$) of the spindle (19), so that the control pressure passed to the passage (C) of the spindle (19) presses the spindle (19) against the spring force of the spring (21).

4. A radial piston hydraulic motor as claimed in claim 1, wherein in the device design in a free rotation situation the device arrangement includes a spindle (19) whose shoulders ($t_2$ and $t_3$) prevent flow communication between the pressure line (B) and the return line (A), so that, in the device arrangement, the passages (23) of the distributor valve (18) communicate with one another through the spindle cavity (20) at the area between the shoulders ($t_2$ and $t_3$), so that the springs ($U_1$, $U_2$ . . . ) hold the pistons (13$a_1$, 13$a_2$ . . . ) and the press wheels (14$a_1$, 14$a_2$ . . . ) associated therewith out of contact with the cam ring (11) and the box (10) of the radial piston hydraulic motor (100) can be rotated freely, and that, in a free rotation situation, the passages (23) of the distributor valve (18) communicate with one another through the spindle cavity (20) at the area between the shoulders ($t_2$ and $t_3$), the hydraulic fluid can flow into a box (K) from below the pistons while assisted by the springs through passages (D, E, F, G), a space (H) and a passage (J), so that the press rollers (14$a_1$, 14$a_2$ . . . ) of the pistons are separated from the cam ring (11) and the motor can be rotated freely.

5. A radial piston hydraulic motor as claimed in claim 4, wherein from a line (E) there is a passage (F and G) which communicates with the space (H) at the end of the spindle cavity (20) and further through a passage (J) with the interior space (K) of the box (10).

6. A radial piston hydraulic motor as claimed in claim 1, wherein in a normal drive state the pressure line (B) communicates with a passage (D) at the area between shoulders ($t_1$ and $t_2$) of the spindle (19) and further with pistons (13$a_1$, 13$a_2$ . . . ) further through the distributor valve (18) and its passages (23), and that other pistons (13$a_1$, 13$a_2$ . . . ) communicate further with a passage (E) through the passages (23) of the distributor valve (18) and further with the return line (A) at the area between shoulders ($t_2$ and $t_3$) of the spindle (19).

7. A radial piston hydraulic motor as claimed in claim 1, wherein the radial piston hydraulic motor (100) includes a rotatable box frame (10) and that the piston frame (12) is non-revolving and placed on a non-revolving central shaft (17), and that there is a distributor valve (18) that is connected to the rotated box frame (10) and rotates with it, and that the spindle (19) is placed in the spindle cavity (20) of the central shaft (17).

8. A method in the control of a radial piston hydraulic motor (100), which radial piston hydraulic motor (100) includes a box frame (10) with a cam ring (11) connected thereto, and that there is a piston frame (12) and pistons (13$a_1$, 13$a_2$ . . . ) moving radially in it and the pistons have press rollers (14$a_1$, 14$a_2$ . . . ), which can be pressed by means of the pressure of a hydraulic fluid, such as hydraulic oil, against an inner surface (11') of the cam ring (11), and that the piston frame is connected to a central shaft (17), and that there is a distributor valve (18) that includes bores (23)

through which the hydraulic fluid, such as hydraulic oil, can be passed into and out of connection with the pistons (13$a_1$, 13$a_2$ . . . ), the device arrangement including a working pressure inlet passage (B) for the hydraulic fluid and a return passage (A) for the hydraulic fluid which is not under working pressure, wherein a free rotation valve (50) built inside the radial piston hydraulic motor (100) is used in the method, which free rotation valve includes a spindle (19) which is moved in a spindle cavity (20), and that in the method, in a free rotation situation, shoulders ($t_1$ and $t_2$) of the spindle (19) block the working pressure inlet and outlet passages (A and B), so that, in a free rotation situation, the pistons (13$a_1$, 13$a_2$ . . . ) and the press rollers (14$a_1$, 14$a_2$ . . . ) associated therewith are pressed by means of springs ($U_1$, $U_2$ . . . ) to a bottom position and out of contact with the cam ring (11), so that the radial piston hydraulic motor (100) can be rotated freely.

9. A method as claimed in claim 8, wherein in the method in a free rotation situation the passages of the distributor valve (18) leading to the pistons (13$a_1$, 13$a_2$ . . . ) which are in the working phase and the passages of the distributor valve (18) leading from the pistons (13$a_1$, 13$a_2$ . . . ) which are in the return phase are connected in series, and that in a free rotation situation said system of passages connected in series is additionally connected to an interior space (K) of the box frame (10).

10. A method as claimed in claim 8 wherein, in the method, control takes place by moving the spindle (19) in the spindle cavity (20) of the central shaft (17).

* * * * *